United States Patent [19]

Nagano et al.

[11] Patent Number: 4,719,885

[45] Date of Patent: Jan. 19, 1988

[54] ELECTRONIC CONTROL FUEL INJECTION DEVICE

[75] Inventors: Masami Nagano; Takeshi Atago, both of Katsuta, Japan

[73] Assignee: Hitachi, Ltd., Japan

[21] Appl. No.: 9,921

[22] Filed: Feb. 2, 1987

[30] Foreign Application Priority Data

Jan. 31, 1986 [JP] Japan ..... 61-17952

[51] Int. Cl.[4] ..... F02N 17/00; F02D 41/06

[52] U.S. Cl. ..... 123/179 L; 123/491

[58] Field of Search ..... 123/179 G, 179 L, 478, 123/480, 491; 364/431.05

[56] References Cited

U.S. PATENT DOCUMENTS 4,438,748 3/1984 Ikeura et al. ..... 123/179 L X
4,478,194 10/1984 Yamato et al. ..... 123/179 L X
4,515,131 5/1985 Suzuki et al. ..... 123/491
4,550,373 10/1985 Ito et al. ..... 123/179 L X
4,582,036 4/1986 Kiuchi et al. ..... 123/179 L X
4,653,452 3/1987 Sawada et al. ..... 123/179 L X

FOREIGN PATENT DOCUMENTS 0045650 12/1974 Japan .
0056632 4/1982 Japan .

*Primary Examiner*—Willis R. Wolfe
*Attorney, Agent, or Firm*—Antonelli, Terry & Wands

[57] ABSTRACT

A fuel at the time of start of an internal combustion engine (8) is supplied dividedly by the injection pulse signals. The injection pulse width ($T_{ST}$) of the injection pulse signals is controlled in accordance with the temperature of the engine fuel chamber (9) of the internal combustion engine.

8 Claims, 19 Drawing Figures

ELECTRONIC CONTROL FUEL INJECTION DEVICE

FIELD OF THE INVENTION

This invention relates to an electronic control fuel injection device which operates a fuel injection valve of an intake system by electric signals and controls a fuel supply quantity.

BACKGROUND OF THE INVENTION

An electronic control fuel injection device is well known in the art as disclosed, for example, in Japanese patent Laid-Open No. 56632/1982 published on Apr. 5, 1982 in the title of "Method of fuel control".

The electronic control fuel injection device to which the present invention is applied will be explained referring to FIG. 1.

In FIG. 1, the flow rate of the air sucked from an air cleaner 1 is controlled by a throttle valve 4 which is disposed in a throttle body 2 and operates in the interlocking arrangement with an acceleration pedal 3 operated by a driver of a car. Then, the air is supplied to a combustion chamber 9 of an internal combustion engine 8 through a surge tank 5, an intake branch pipe 6 and an intake valve 7. The fuel-air mixture burnt in the combustion chamber 9 is discharged into the atmosphere through an exhaust valve 10 and an exhaust branch pipe 11. A fuel injection valve 14 is disposed in the intake branch pipe 6 in such a manner as to correspond to the combustion chamber 9, but one fuel injection valve may be disposed upstream of the throttle valve 4.

An electronic control unit 15 comprises a microprocessor as an operation unit, read-only memories (ROMs), random-access memories (RAMs) and an input/output device (I/O port). The electronic control unit 15 receives input signals from a throttle sensor 16 for detecting the full open state of the throttle valve 4, a water temperature sensor 18 fitted to a water jacket 17 which is used for cooling the engine, a heat wire type air flow meter 19 for measuring the intake air quantity, an intake air temperature sensor 20 for detecting the intake air temperature, a rotating angle sensor 23 for detecting the rotating angle of a distributor 33, which controls the ignition timing of the engine, coupled to a crank shaft in order to detect the rotating angle of the crank shaft coupled to a piston 21 through a connecting rod 22, an ignition switch 24 and a starter switch 25.

The rotating angle sensor 23 includes a position sensor 26 which generates one pulse whenever the crank shaft rotates twice and an angle sensor 27 which generates a pulse whenever the crank shaft (not shown) rotates by a predetermined angle such as 30°, for example.

The fuel is pressure-fed by a fuel pump 31 to the fuel injection valve 14 from a fuel tank 30 through a fuel passage 29. The electronic control unit 15 calculates a fuel injection quantity and a fuel injection timing on the basis of various input signals, sends a fuel injection pulse to the fuel injection valve 14, calculates the ignition timing and sends a current to the ignition coil 32. A primary current of the ignition coil 32 is sent to the distributor 33 and then to an ignition plug.

FIG. 2 is a block diagram showing the construction of the electronic control unit 15. The outputs of the water temperature sensor 18, the air flow sensor 19, the intake air temperature sensor 20 and the throttle sensor 16 are sent to an A/D converter 34 and are converted to digital signals. A revolution sensor 35 includes a gate which is opened and closed by the pulses from the angle sensor 27 of the rotating angle sensor 23 and a counter which counts the clock pulses sent thereto from a clock pulse generator 36 through this gate, and a value inversely proportional to the number of revolution N is generated as the output of the counter.

The outputs of the ignition switch 24, the starter switch 25 and the position sensor 26 of the rotating angle sensor 23 are temporarily stored in a latch circuit 37. The microprocessor 40 is connected to ROM 42, RAM 43 and other blocks 34, 35, 37 through a bus line 41 and calculates the fuel injection quantity on the basis of a predetermined program. The value corresponding to this fuel injection quantity is stored in a fuel injection control circuit 44, and when this stored value is in agreement with the clock pulse, the output pulse is generated and is sent to the fuel injection valve 14 through a driving circuit 45.

Correction of acceleration and deceleration of a car is controlled by increasing and decreasing the fuel by receiving the output from the throttle sensor 16 and processing it in the microprocessor 40.

In the fuel injection device of the kind explained above, when the starter switch signal is turned on and cranking is effected as shown in the chart (a) of FIG. 3, the injection start signal is generated as shown in the chart (b) and the injection pulses are applied to the fuel injection valve as shown in the chart (c).

Here, the injection pulses ar divided into $T_{ON}$ and $T_{OFF}$ between the injection start signals, and $T_{ON}$ is changed by the temperature of cooling water.

However, there exists the problem that the fuel does not evaporates suitably because large quantities of fuel is supplied at one time only for the $T_{ON}$ period so that the fuel-air mixture density inside the fuel chamber is not optimized, and start ability is not very good. This problem becomes all the more remarkable with a lower temperature.

For solving the problem explained above, "Method of fuel control of gasoline injection engine at the time of start" was invented as shown in Japanese patent publication No. 45650/1974 published on Dec. 5, 1984. This prior art discloses that injection pulses are generated continuously between preceding and succeeding injection start signals.

However, there exists the problem that the fuel is consumed excessively more than the necessary fuel for the engine because the fuel is injected successively without judging necessary quantity of the fuel.

SUMMARY OF THE INVENTION

An object of the present invention is to provide an electronic control fuel injection device which optimizes the fuel-air mixture density inside the fuel chamber and optimizes the fuel consumption of the engine.

In accordance with the present invention, the fuel at the time of start is supplied dividedly by the injection pulse signals and the width of the pulse train of the injection pulse signals is controlled in accordance with the temperature of the engine fuel chamber, so that the fuel evaporates sufficiently and is kept in a suitable fuel-air mixture density and the fuel supply to the engine is optimized by the detected temperature of the engine fuel chamber.

DETAILED DESCRIPTION OF THE PREFERRED EMBODIMENTS

Hereinafter, one embodiment of the present invention will be described in detail. First of all, the fundamental concept of the present invention will be explained with reference to FIGS. 4 and 5.

Figure 1:
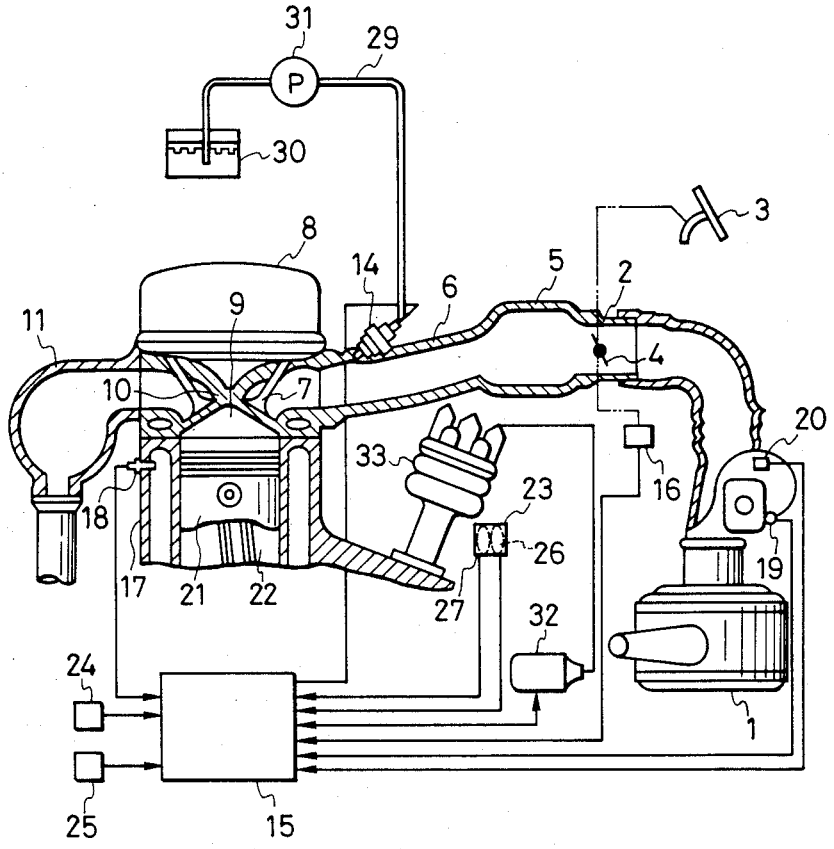
FIG. 1 PRIOR ART
FIG. 1 shows a structural view of a conventional electronic fuel injection device.
Figure 2:
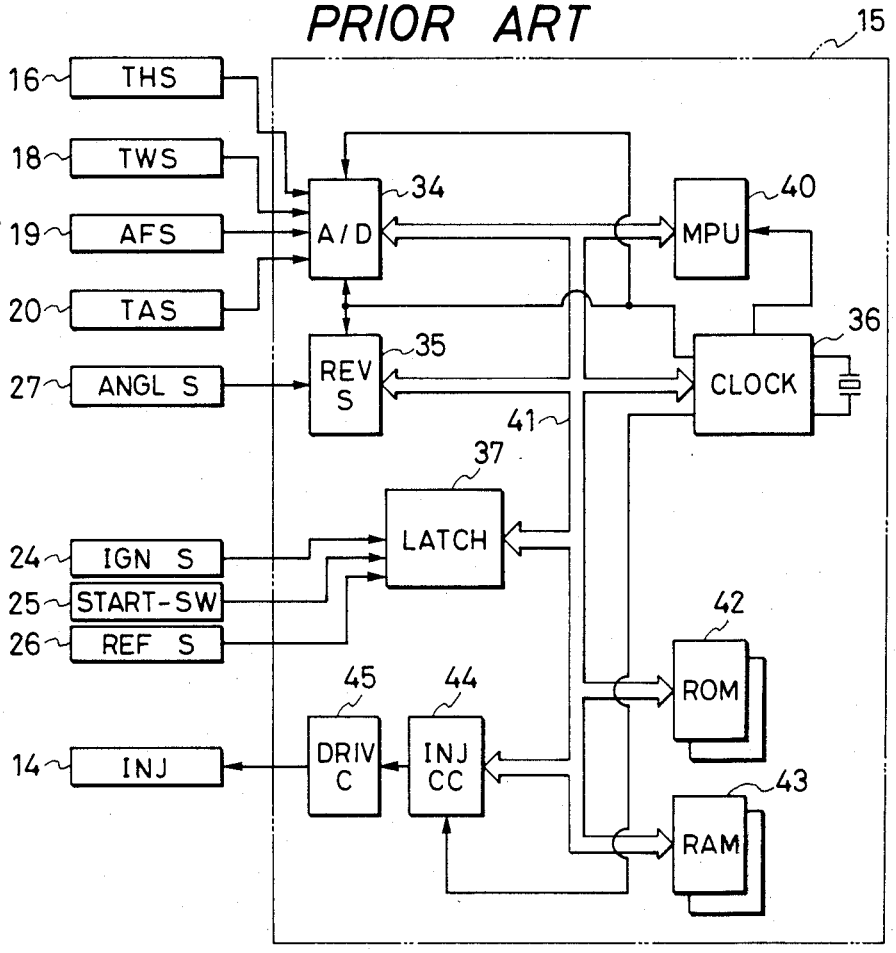
FIG. 2 PRIOR ART
FIG. 2 shows a structural view of a controlling device shown in FIG. 1.
Figure 3:
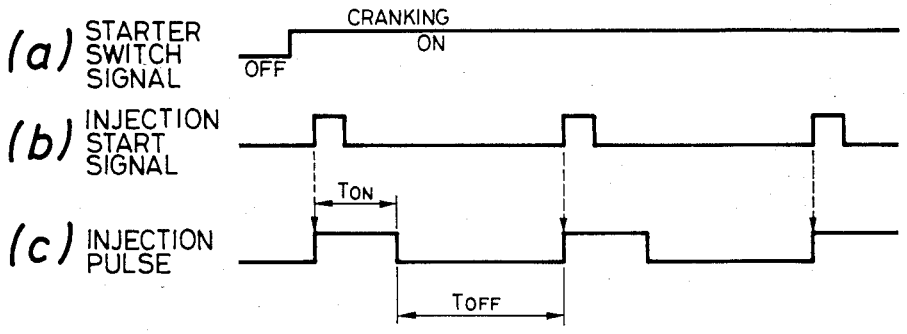
FIG. 3 PRIOR ART
FIGS. 3*a–c* show a time chart showing a start pulse generation method in the controlling device shown in FIG. 2.
Figure 4:
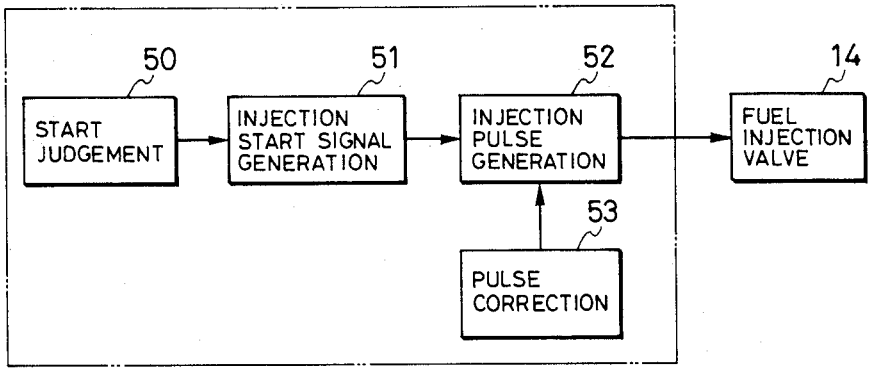
FIG. 4 shows a block diagram for explaining function of the present invention.

Referring to FIG. 4, the numeral 15 corresponds to the injection start signal generation means in FIG. 2.

Figure 5:
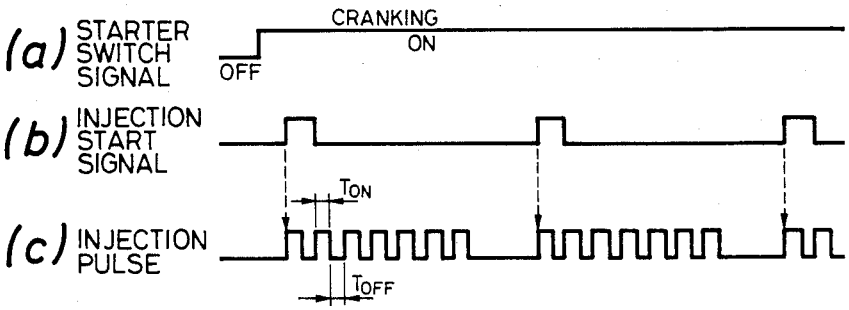
FIGS. 5*a–c* show a time chart showing the start pulse generation method of the present invention.

In FIG. 4, reference numeral 50 represents start judgement means, which judges the start by turn-on of the starter switch, for example, and generates the signal shown in the chart (a) of FIG. 5.

When the state of the engine is judged as the cranking state by the start judgement means 50, the engine 8 is rotated by the starter so that the injection start signal generation means 51 generates the injection start signal shown in the chart (b) of FIG. 5. The reference signal from the crank angle sensor or the primary current signal of the ignition device is used as this injection start signal.

When the injection start signal is generated from the injection start signal generation means 51, the injection pulses shown in the chart (c) of FIG. 5 are generated by the injection pulse generation means 52 in synchronism with the former. At least two injection pulses are generated between preceding and succeeding injection start signals.

Here, the number or time of the injection pulses is corrected by the pulse correction means 53, and various parameters are used for this correction as explained later.

The fuel injection valve 14 is controlled by the output signal of the injection pulse generation means 52.

Next, the flow chart when the concept shown in FIG. 4 is executed by a microcomputer will be explained with reference to FIG. 6.

Figure 6:
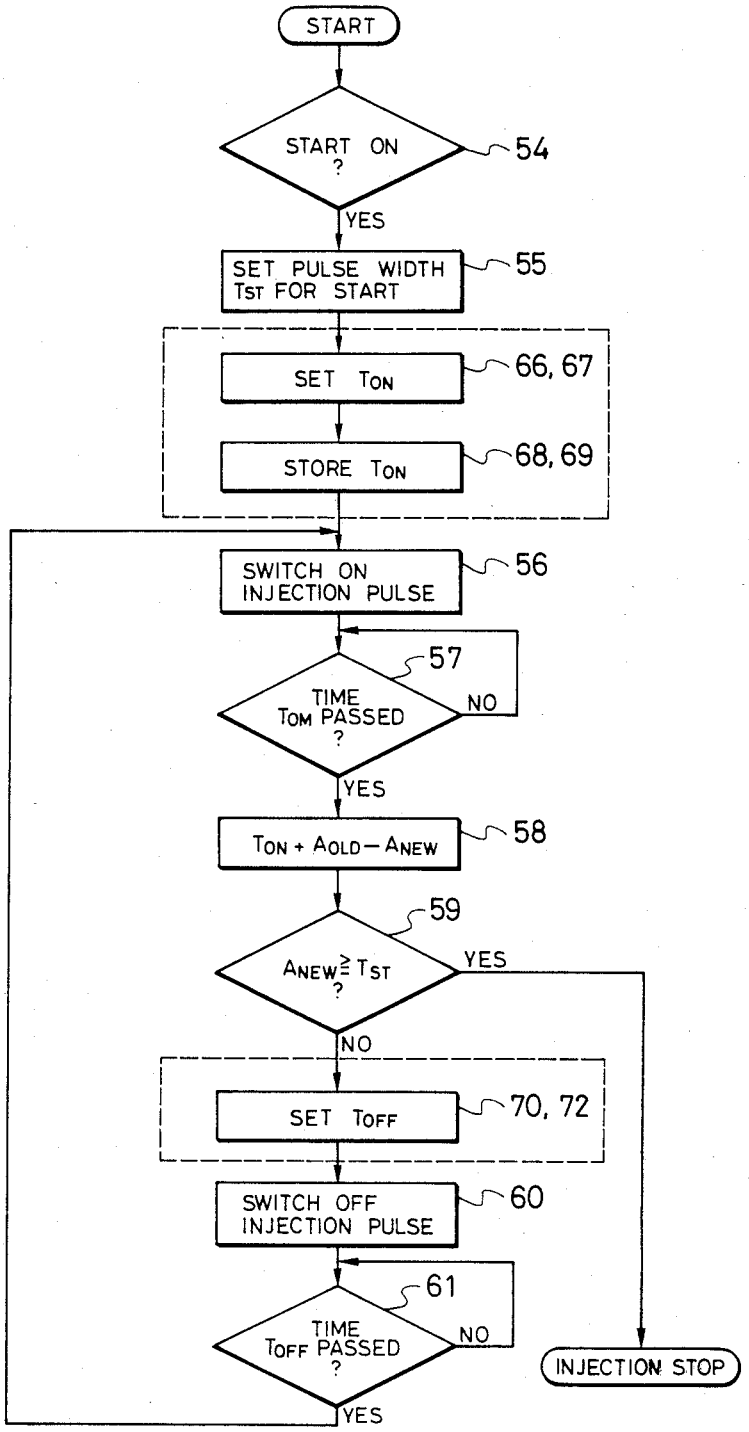
FIG. 6 shows a flow chart applied to the present invention.

In FIG. 6, whether or not the starter switch is ON is judged at step 54 and if it is ON, the state is judged as the cranking state and the flow proceeds to step 55. Step 54 corresponds to the start judgement means 50, and step 55 corresponds to the injection start signal generation means 51 shown in FIG. 4.

Figure 7:
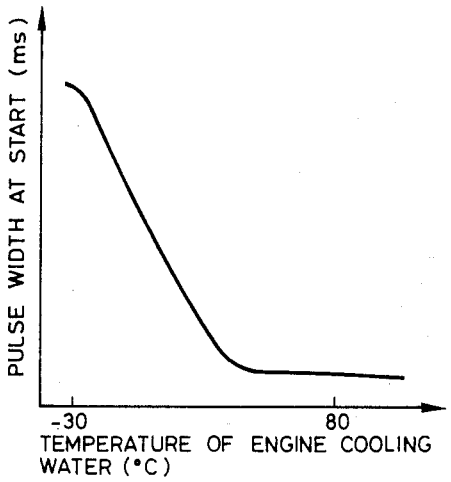
FIG. 7 shows a pulse width characteristic diagram corresponding to engine cooling water temperature for obtaining a fuel quantity necessary for the start of the engine at step 55 of FIG. 6.

At step 55, a fuel quantity necessary for the start of the engine is obtained from a cooling water temperature-v-pulse width characteristic diagram shown in FIG. 7 and is set. This characteristic is stored in ROM of the microcomputer and is read out in a predetermined period which is set in the microcomputer.

At step 55, a fuel quantity necessary for the start of the engine can be obtained from a engine oil temperature-v-pulse width characteristic diagram (not shown) instead of the cooling water temperature-v-pulse width characteristic diagram shown in FIG. 7. The engine oil temperature-v-pulse width characteristic diagram is similar to the cooling water temperature-v-pulse width characteristic diagram. Both the engine oil temperature-v-pulse width characteristic diagram and the cooling water temperature-v-pulse width characteristic diagram have a characteristic in which the pulse width $T_{ST}$ varies depending on temperature of the engine fuel chamber in such a manner that the number of the injection pulses increases with a low temperature of the internal combustion engine. The fuel quantity is expressed as the injection pulse width $T_{ST}$. The injection pulse width $T_{ST}$ is represented by $T_{ON} \times n$ or $n(T_{ON}+T_{OFF})$. $T_{ON}$ represents a opening time interval of the fuel injection valve 14 shown in FIG. 5(*c*). $T_{OFF}$ represents a closing time interval of the fuel injection valve 14 shown in FIG. 5(*c*). According to the characteristic diagram shown in FIG. 7, the injection pulse width $T_{ST}$ is controlled between preceding and succeeding injection start signals as shown in FIG. 5 (*c*) by the following steps.

When steps 66, 67, 68, and 69 are not performed, the injection pulses are applied to the fuel injection valve 14 in synchronism with the injection start signals at step 56 and the fuel is injected. Step 56 corresponds to the injection pulse generation means 52 shown in FIG. 4.

Next, the timer measures the injection pulse generation time at the microcomputer, and whether or not it exceeds the $T_{ON}$ time shown in FIG. 5 is judged at step 57. If it does not, the step 57 is repeated once again and if it does, the flow proceeds to step 58.

At step 58, $T_{ON}$ executed is added to the total time $A_{OLD}$ of the injection pulses to obtain a new total time $A_{NEW}$.

This total time $A_{NEW}$ is compared at step 59 with the injection pulse width $T_{ST}$ obtained at step 55 and if the total time $A_{NEW}$ is greater than the injection pulse width $T_{ST}$, the fuel injection is stopped till the next injection start signal arrives. If the total time $A_{NEW}$ is smaller than the injection pulse width $T_{ST}$, the flow proceeds to step 60, when steps 70 to 72 are not performed.

At step 60, the injection pulse output is cut off and the supply of fuel from the injection valve 14 is stopped.

At step 61, the time in which the injection pulses are not outputted is measured by the timer and whether or not this time exceeds the $T_{OFF}$ time shown in FIG. 5 is judged. If it does not, step 61 is repeated once again and if it does, the flow returns to step 56 and the previous procedures are executed once again.

When this flow chart is executed, the injection pulses shown in the chart (c) of FIG. 5 can be obtained.

Although at step 55 of FIG. 6, the fuel quantity necessary for the start is obtained from a cooling water temperature-v-pulse width characteristic diagram shown in FIG. 7 depending on the cooling water temperature, this fuel quantity can be controlled by a constant length pulse train of the injection pulse width $T_{ST}$. This constant length pulse train of the injection pulse width $T_{ST}$ is set to a pulse width corresponding to the engine cooling water temperature of −30° C. There is a rule that the engine of a car has to be started even if at the engine cooling water temperature of −30° C. Even if the engine cooling water temperature is −30° C., the length of the pulse width $T_{ST}$ is shorter than that of the interval between preceding and succeeding injection start signals as shown in FIG. 6(*c*).

Next, correction of the injection pulses will be explained.

First of all, the injection pulse width $T_{ST}$ must be corrected at the start because a battery voltage drops. This correction is made in accordance with the flow chart shown in FIG. 8.

Figure 8:
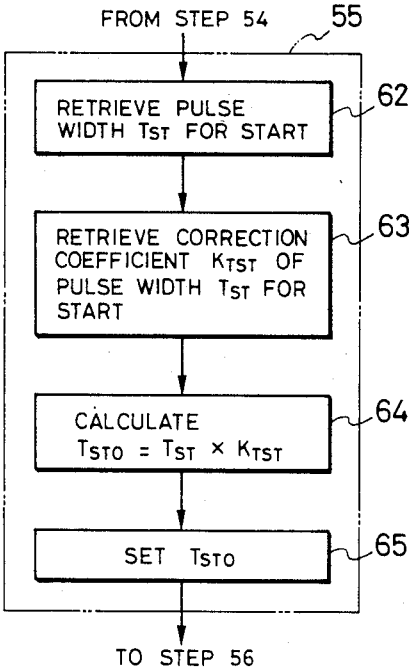
FIG. 8 shows a flow chart for explaining in detail the step of FIG. 6.

In FIG. 8, the injection pulse width $T_{ST}$ for the start is read from ROM at step 62.

Figure 9:
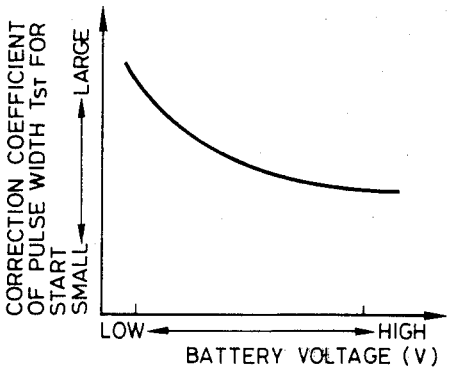
FIG. 9 shows a correction coefficient characteristic diagram corresponding to battery voltage for obtaining the correction coefficient at step 63 of FIG. 8.

At step 63, a correction coefficient $T_{TST}$ is read from a battery voltage-v-correction coefficient diagram of FIG. 9. This coefficient has a value such that the lower the battery voltage, the greater becomes the injection quantity.

A corrected injection pulse width $T_{STO}$ is determined from these data at step 64 in accordance with the following formula (1):

$$T_{STO}=T_{ST}\times T_{TST} \quad (1)$$

This pulse width $T_{STO}$ is set at step 65 and the flow then proceeds to step 56.

Correction of the battery voltage fluctuation can be made by executing the flow chart described above.

Next $T_{ON}$ and $T_{OFF}$ time of the injection pulses may be constant, but a greater number of problems can be solved by changing the $T_{ON}$ and $T_{OFF}$ time.

For example, there might be a problem that when the battery voltage drops, the valve opening characteristics of the fuel injection valve get deteriorated and a fuel quantity becomes drastically smaller than the predetermined value.

Figure 10:
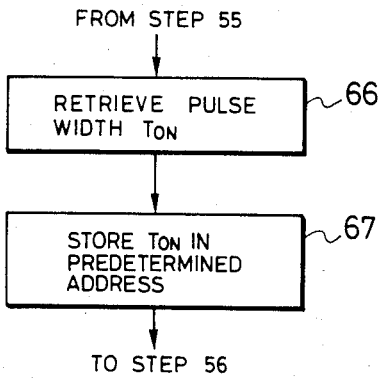
FIG. 10 shows a flow chart, steps of which is applicable between steps 55 and 56 of FIG. 6 for correcting deterioration of valve opening characteristics.
Figure 11:
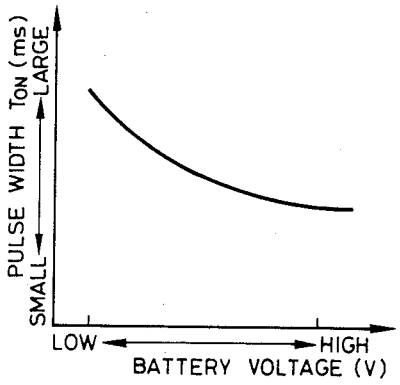
FIG. 11 shows the pulse width characteristic diagram corresponding to the battery voltage for obtaining the pulse width at step 66 of FIG. 10.

Accordingly, $T_{ON}$ is read from the battery voltage-v-$T_{ON}$ diagram shown in FIG. 11 at step 66 shown in FIG. 10. This pulse width $T_{ON}$ has the characteristics such that it becomes greater with a greater drop of the battery voltage. Accordingly, the decrease of the fuel quantity due to deterioration of the valve opening characteristics can be corrected.

Next, the pulse width $T_{ON}$ is stored in a predetermined address at the ROM at step 67 and the flow proceeds to step 56. Therefore, $T_{ON}$ which is used thereafter at step 57 is corrected $T_{ON}$.

Besides correction of the battery voltage, the $T_{ON}$ time can be changed by detecting the temperature of the engine cooling water.

In other words, when the temperature of the engine cooling is higher, the engine can be started even if a greater quantity of fuel is supplied for the start, because when the temperature of the engine cooling water is higher, the fuel, such as gasoline, can be more easily vaporized.

Figure 12:
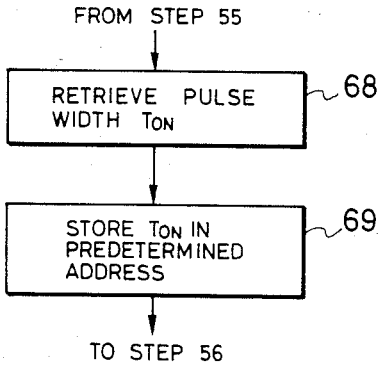
FIG. 12 shows a flow chart, steps of which is applicable between steps 55 and 56 of FIG. 6 for correcting the pulse width corresponding to cooling water temperature.
Figure 13:
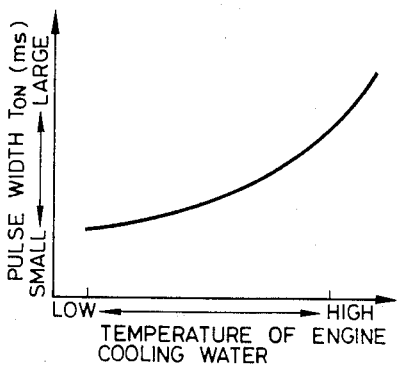
FIG. 13 shows the pulse width characteristic diagram corresponding to the cooling water temperature for obtaining the pulse width at step 68 of FIG. 12.

In FIG. 12, $T_{ON}$ is read from the cooling water temperature-v-$T_{ON}$ characteristic diagram shown in FIG. 13 at step 68. This pulse width $T_{ON}$ has characteristics such that it becomes greater with a higher temperature of the cooling water.

Next, the pulse width $T_{ON}$ is stored in a predetermined address at the ROM at step 69 and the flow proceeds to step 56. The pulse width $T_{ON}$ which is thereafter used at step 57 is the corrected width $T_{ON}$.

It is of course possible to combine correction of the battery voltage shown in FIGS. 10, 11 with correction of cooling water shown in FIGS. 12, 13 between step 55 and step 56 as shown in FIG. 6.

There is still another problem that the necessary quantity of fuel can not be obtained, when the rotation speed of the engine is increased, if the time interval of $T_{OFF}$ is not shortened by the following reason.

The time interval between preceding and succeeding injection start signals is decided by that of the reference or crank angle signals generated by the position sensor 26. When the rotation speed of the engine is increased, the time interval between the injection start signals is shorten, since the time interval between preceding and succeeding signals generated by the position sensor 26 is also shortened. When the rotation speed of the engine is increased, if the total time intervals of $T_{OFF}$ are not shortened, the necessary quantity of fuel is not always supplied to the engine.

Figure 14:
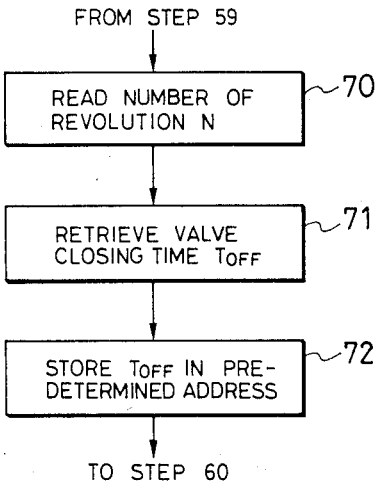
FIG. 14 shows a flow chart, steps of which are applicable between steps 59 and 60 of FIG. 6 for correcting the pulse width corresponding to engine speed.
Figure 15:
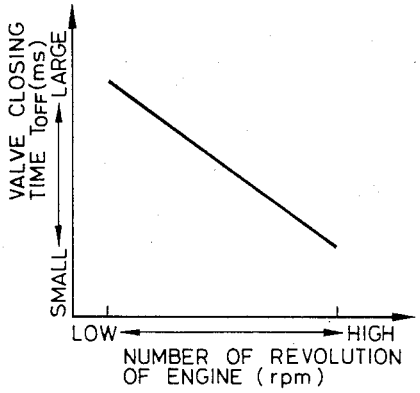
FIG. 15 shows the valve closing time characteristic diagram corresponding to the engine speed for obtaining the valve closing time at step 70 of FIG. 14.

Accordingly, the number of revolution N is detected at step 70 as shown in FIG. 14 and $T_{OFF}$ is read from the number-of-revolution-v-$T_{OFF}$ characteristic diagram shown in FIG.15 at step 71.

Next, this $T_{OFF}$ is stored in a predetermined address at the ROM at step 72 and the flow proceeds to step 56. Therefore, $T_{OFF}$ used at step 61 is this corrected $T_{OFF}$.

Here, the $T_{OFF}$ characteristic diagram shown in FIG.15 is determined so that at least two $T_{ONs}$ can be generated between the injection start signals.

According to the present invention described above, the fuel is injected at least twice between the preceding and succeeding injection start signals in accordance with the temperature of the engine fuel chamber so that evaporation of the fuel can be made sufficiently without consuming unnecessary fuel for the engine and start ability can be improved remarkably.

What we claim is:

1. An electronic control fuel injection device comprising (a) a fuel injection valve (14) disposed in an intake system and driven electrically, (b) start judgement means (50) for judging the cranking state of an internal combustion engine (8), (c) fuel injection start signal generation means (51) for generating an injection start signal determining the injection start timing of said fuel injection valve

(14) when said start judgement means (50) judges the cranking state; and (d) injection pulse generation means (52) for generating a injection pulse for opening said fuel injection valve (14) between preceding and succeeding injection start signals generated from said injection start signal generation means (51), characterized in that further comprising pulse correction means (53) for controlling said injection pulse generation means (52) in such a manner that the number of said injection pulses is increased with a lower temperature of said internal combustion engine (8).

2. The electronic control fuel injection device as defined in claim 1 wherein said pulse correction means (53) controls said number of said injection pulses corresponding to the temperature of the engine fuel chamber (9) of said internal combustion engine (8).

3. The electronic control fuel injection device as defined in claim 1 wherein said pulse correction means (53) controls said number of said injection pulses corresponding to the temperature of the engine cooling water of said internal combustion engine (8).

4. The electronic control fuel injection device as defined in claim 1 wherein said pulse correction means (53) controls said number of said injection pulses at constant corresponding to the temperature of −30° C. of the engine cooling water of said internal combustion engine (8).

5. The electronic control fuel injection device as defined in claim 1 wherein said pulse correction means (53) controls said number of said injection pulses corresponding to voltage of a battery which is used for switching ON a starter switch (25) of said internal combustion engine (8).

6. The electronic control fuel injection device as defined in claim 1 wherein said pulse correction means (53) controls a pulse width ($T_{ON}$) of said injection pulse corresponding to voltage of the battery which is used for switching ON the starter switch (25) of said internal combustion engine.

7. The electronic control fuel injection device as defined in claim 1 wherein said pulse correction means (53) controls the pulse width ($T_{ON}$) of said injection pulse corresponding to the temperature of the engine cooling water of said internal combustion engine (8).

8. The electronic control fuel injection device as defined in claim 1 wherein said pulse correction means (53) controls a closing time interval ($T_{OFF}$) of said fuel injection valve (14) corresponding to a rotation speed of said internal combustion engine (8).

* * * * *